US006175340B1

(12) United States Patent
Olds et al.

(10) Patent No.: US 6,175,340 B1
(45) Date of Patent: Jan. 16, 2001

(54) HYBRID GEOSTATIONARY AND LOW EARTH ORBIT SATELLITE GROUND STATION ANTENNA

(75) Inventors: Keith Andrew Olds, Mesa; Carl Myron Wagner, Higley; John Wesley Locke, Tempe, all of AZ (US)

(73) Assignee: Motorola, Inc., Schaumburg, IL (US)

( * ) Notice: Under 35 U.S.C. 154(b), the term of this patent shall be extended for 0 days.

(21) Appl. No.: 09/071,043

(22) Filed: May 4, 1998

(51) Int. Cl.[7] ..... H01Q 21/00

(52) U.S. Cl. ..... 343/893; 343/824; 455/12.1; 455/427

(58) Field of Search ..... 343/824, 713, 343/786, 840, DIG. 2, 893; 455/12.1, 427; H01Q 21/00

(56) References Cited

U.S. PATENT DOCUMENTS 4,975,707 * 12/1990 Smith ..... 342/357
5,398,035 * 3/1995 Densmore et al. ..... 343/713
5,543,811 * 8/1996 Chethik ..... 343/844
5,589,834 * 12/1996 Weinberg ..... 342/354
5,708,963 * 1/1998 Mobley et al. ..... 455/12.1
5,822,680 * 10/1998 Stuart et al. ..... 455/12.1
5,862,478 * 1/1999 Cutler, Jr. et al. ..... 455/428
5,887,257 * 3/1999 Olds ..... 455/427

* cited by examiner

*Primary Examiner*—Don Wong
*Assistant Examiner*—Shih-Chao Chen
(74) *Attorney, Agent, or Firm*—Frank J. Bogacz; Jeff D. Limon; Timothy J. Lorenz

(57) ABSTRACT

A hybrid geostationary and low earth orbit (LEO) ground station antenna provides a geostationary receive antenna (30) which generates a narrow receive antenna beam for use with geostationary satellites. The ground station antenna can be either manually positioned so that the normal boresight of the antenna is directed toward the geostationary satellite serving the subscriber, or may be positioned using a cradle (170) which provides motion in the pitch, roll, and yaw axes. The ground station antenna also includes a LEO receive antenna (40) and a LEO transmit antenna (50) which receive which communicate with LEO satellites by way of wider beam, lower gain antenna beams. The geostationary receive antenna (30) is used in conjunction with the LEO satellites and during operations which involve communication with both types of satellites.

17 Claims, 2 Drawing Sheets

HYBRID GEOSTATIONARY AND LOW EARTH ORBIT SATELLITE GROUND STATION ANTENNA

FIELD OF THE INVENTION

The invention relates generally to antennas and, more particularly, to ground station antennas which communicate with geostationary and low earth orbit satellites.

BACKGROUND OF THE INVENTION

In a hybrid communication system where a ground station communicates with both geostationary and low earth orbit satellites, the ground station antenna must be designed in order to facilitate communications with both types of satellites. Typically, the gain requirements of a ground station antenna which communicates with a geostationary satellite are different than the gain requirements of a ground station which communicates with a low earth orbit satellite. For communications with a geostationary satellite, it is generally required that antenna beams be high gain and narrow beam. High gain antenna beams are required due to the distance (36,000 Km) of the geostationary satellite from the ground station. Narrow beams are used in order to minimize the potential for interference with adjacent geostationary satellites. When communication with a second geostationary satellite is required, the antenna beam can be repositioned in order to establish communications with the second satellite.

For communications with a low earth orbit satellite, where the satellites are constantly in motion relative to the ground station, it is generally required that receive and transmit antenna beams be somewhat wider in beamwidth as well as requiring continuous beam scanning in order to maintain contact with the satellite. Since the low earth orbit satellites are closer to the ground station than geostationary satellites (between 500 and 1400 Km), receive and transmit antenna beams can be lower in gain. Further, it is generally desirable to use two antennas when communicating with a low earth orbit satellite system so that communications are not interrupted during hand-off from one satellite to another.

An electronically scanned phased array antenna has the potential to provide a small, aesthetically attractive, and reliable ground station antenna for communications with both geostationary and low earth orbit satellites. However, when a transmit or receive antenna beam is electronically scanned away from the natural boresight of the antenna, a degradation in antenna gain known as "scan loss" results. In addition to a degradation in antenna gain, the receive or transmit antenna beamwidth increases. These effects create difficulties in using the same antenna for communications with a low earth orbit satellite and a geostationary satellite when the same antenna is used. For communicating with a geostationary satellite, the loss of antenna gain makes the ground-to-satellite communications link difficult to establish and maintain. Additionally, any widening of an antenna beam can create an interference with neighboring geostationary satellites placed close to the desired satellite. Further, in a hybrid system with both geostationary and low earth orbit satellites as many as four antenna apertures could be required (1 antenna used for receiving signals from a geostationary satellite, 2 antennas for receiving signals from low earth orbit satellite, and 1 antenna for transmitting signals to a low earth orbit satellite).

Therefore, what is needed is a ground station antenna which can be used to provide receive and transmit beams which facilitate communications with both geostationary and low earth orbit satellites.

DESCRIPTION OF THE PREFERRED EMBODIMENTS

A hybrid geostationary and low earth orbit satellite ground station antenna facilitates simultaneous communications with both types of satellites using passive or active phased array technology. The antenna is mechanically positioned so as to provide a high gain, narrow antenna beam in the direction of a geostationary satellite while allowing antenna beams which provide communications with low earth orbit satellites to scan as required to maintain contact with these satellites. The antennas are mounted within a single enclosure which can be mounted to the roof of a subscriber's residence.

Figure 1:
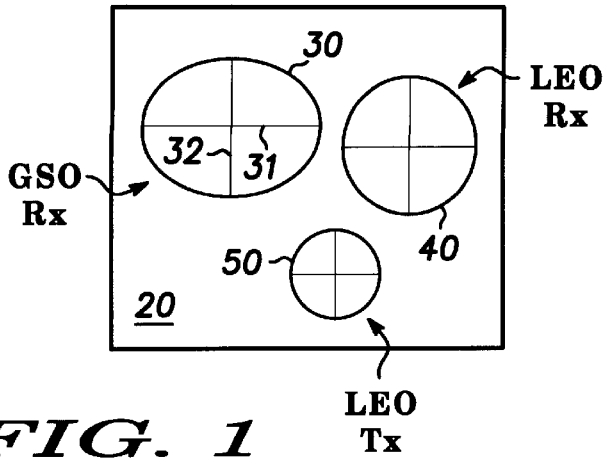
FIG. 1 illustrates a plan view of a ground station antenna which provides communications with both geostationary and low earth orbit satellites in accordance with a preferred embodiment of the invention.

In FIG. 1 three phased array antennas incorporating passive components are located on a preferably coplanar mounting surface. In a preferred embodiment, geostationary satellite receive antenna 30, comprises a phased array of elements which generate a receive antenna beam. The antenna elements which comprise geostationary receive antenna 30, may be of any type or construction such as a dipole, monopole above a ground plane, patch, or any other conductive element which receives an electromagnetic wave as a function of the electrical current present on the surface of the element. Additionally, each element may also be of the aperture type such as a waveguide slot, horn, or any other type of nonconducting element which receives an electromagnetic wave as a function of the electric field present within the aperture. The techniques of design and construction of the radiating elements which comprise geostationary receive antenna 30 are well known to those of ordinary skill in the art.

In a preferred embodiment, geostationary receive antenna 30, is elliptical in shape with major and minor axes of 31 and 32, respectively. The elliptical shape allows the antenna to possess gain properties along the major axis which are different than the gain properties along the minor axis. Thus, if geostationary receive antenna 30 is oriented such that major axis 31 of the ellipse is parallel to the geostationary satellite belt (which lies above the equator), the antenna will be capable of receiving a signal from the desired satellite and avoid interference from neighboring satellites. In a preferred embodiment, the length of minor axis 32 is determined according to the overall gain requirements of the receive antenna beam.

As an example of geostationary receive antenna 30, an aperture possessing a major axis (31) length of seventy centimeters provides an approximately two degree beamwidth when operated at 20 GHz. Thus, if another geostationary satellite were located two degrees from the desired geostationary satellite, geostationary receive antenna 30 would receive only minimal interference from the neighboring satellite.

FIG. 1 also includes low earth orbit receive antenna 40 and low earth orbit transmit antenna 50. In a preferred embodiment, each of these antennas is physically smaller in size than geostationary receive antenna 30. This size reduction is possible due to the decreased distance from the ground station antenna to each of the low earth orbit satellites. In a preferred embodiment, antennas 40 and 50 are sized according to conventional techniques in order to provide adequate link margin for satellites with altitudes of between 500 and 1400 kilometers. The antenna elements which comprise low earth orbit receive antenna 40 and low earth orbit transmit antenna 50 can be comprised of the same type of elements which comprise geostationary receive antenna 30 but may be sized differently, if a different operating frequency is to be used.

In an alternative embodiment, one or both of low earth orbit antennas 40 and 50 are intended for use with a geostationary satellite. Thus, low earth orbit antennas 40 and 50 would be similar in size to geostationary receive antenna 30 and comprise a similar number of antenna elements. In this alternate embodiment, the gain properties of the antennas can be modified to lower the transmit or receive antenna gain and widen the beam through a process known as beam "spoiling".

In a preferred embodiment, geostationary receive antenna 30 is used to receive broadcasts from a geostationary satellite. These broadcasts may include high bandwidth video such as entertainment and distance learning where a single geostationary satellite transmits to a substantial number of subscribers. When a particular subscriber has a need to interact with the service provider, this interaction is handled through communications with the low earth orbit satellites which comprise the hybrid communication system using low earth orbit transmit antenna 50 and low earth orbit receive antenna 40. Thus, at any given instant, all three of antennas 30, 40, and 50 can be simultaneously generating receive or transmit beams.

In a preferred embodiment, each of antennas 30, 40, and 50 are mounted on coplanar mounting surface 20. Although no requirement for coplanar mounting exists, coplanar mounting is preferred since it is simple and cost-effective. Additionally, coplanar mounting allows each antenna to maintain an identical boresight angle. Though shown as rectangular, coplanar mounting surface 20 can be any desired shape such as triangular or trapezoidal.

Figure 2:
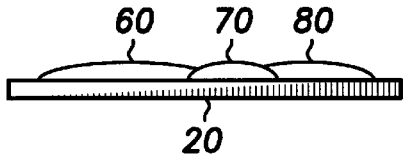
FIG. 2 illustrates a side view of the ground station antenna depicted in FIG. 1 in accordance with a preferred embodiment of the invention.

FIG. 2 illustrates a side view of the ground station antenna of FIG. 1 in accordance with a preferred embodiment of the invention. In FIG. 2, each antenna of FIG. 1 has been enclosed in radome 60. In a preferred embodiment, radome 60 is affixed to geostationary satellite receive antenna 30, radome 70 is affixed to low earth orbit receive antenna 50, and radome 80 is affixed to low earth orbit transmit antenna 40. The use of radomes 60, 70, and 80 does not inhibit functionality, but can provide protection of the antenna elements which comprise each of the three antennas from rain, debris, and other environmental hazards. Radomes 60, 70, and 80 are desirably constructed of a material which provides a low dielectric constant, as well as possessing suitable material properties which allow electromagnetic wave propagation without significant distortion of either amplitude or phase.

Figure 3:
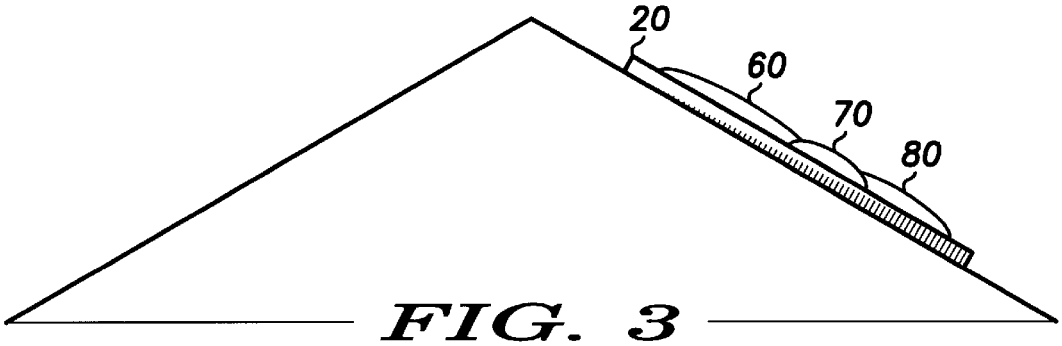
FIG. 3 illustrates a side view of the ground station antenna depicted in FIG. 1 installed on a subscriber's roof in accordance with a preferred embodiment of the invention.

FIG. 3 illustrates a side view of the ground station antenna of FIG. 2 installed on a subscriber's roof. In a preferred embodiment, the face of the ground station antenna is directed so that the natural boresight of the that serves the region where the ground station antenna is located. The receive beam of low earth orbit receive and transmit antennas 40 and 50 are scanned when communications with a low earth orbit satellite is desired. In a preferred embodiment, the low earth orbit satellite constellation would be inclined so that most satellites will be directly overhead or South when viewed from northern temperate latitudes. This allows the ground station antenna to be angled so that it points at the geostationary satellite arc (which is over the equator) from anywhere in the temperate or tropical latitudes while still keeping all of the low earth orbit satellites within the practical scan range of antennas 40 and 50.

Figure 4:
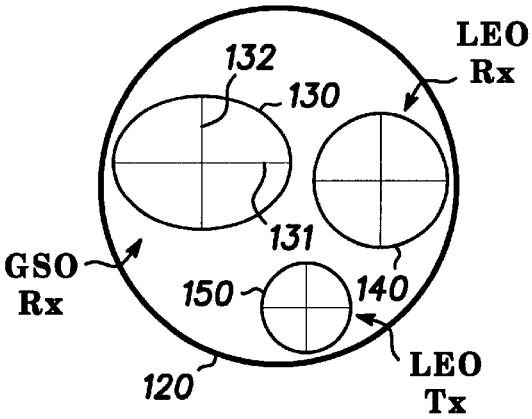
FIG. 4 illustrates a plan view of a ground station antenna which provides communication with both low earth orbit and geostationary satellites in accordance with an alternative embodiment of the invention.

FIG. 4 illustrates a plan view of a ground station antenna which provides communications with both low earth orbit and geostationary satellites in accordance with an alternative embodiment of the invention. In FIG. 4, geostationary receive antenna 130, low earth orbit receive antenna 140, and low earth orbit transmit antenna 150 are all mounted to coplanar mounting surface 120. In a preferred embodiment, each antenna is similar to those described in reference to FIG. 1, including geostationary receive antenna 130 being elliptical in shape with major and minor axes of 131 and 132, respectively.

Figure 5:
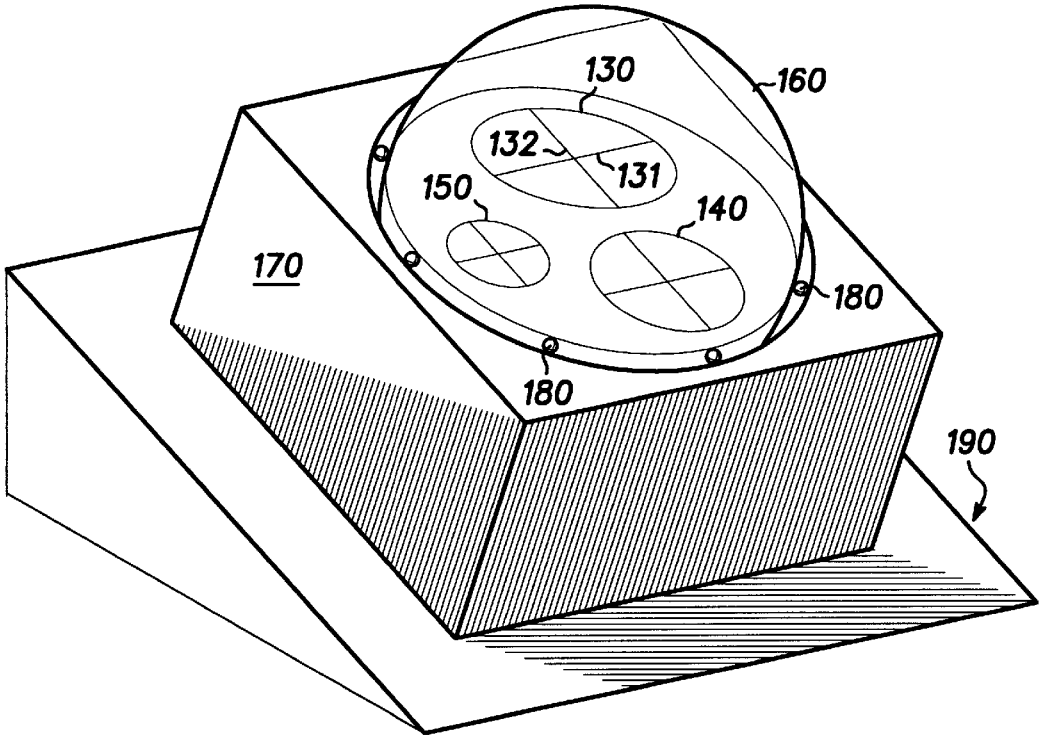
FIG. 5 illustrates a side view of the ground station antenna of FIG. 4 mounted in a movable cradle assembly in accordance with an alternative embodiment of the invention.

FIG. 5 illustrates the ground station antenna of FIG. 4 mounted in a movable cradle assembly in accordance with an alternative embodiment of the invention. In FIG. 5, each antenna has been covered with radome 160, and installed within cradle 170. Movement of cradle 170, is facilitated by rollers 180. Rollers 180, which may comprise ball-bearings or other suitable low friction elements, allow movement in the pitch, roll, and yaw axes. Cradle 170 can then be mounted to rooftop 190 in order to provide communications services to an individual subscriber.

The use of cradle 170 and rollers 180 allow the ground station antenna to be repositioned in order to receive a signal from other geostationary satellites. This allows the narrow geostationary antenna beam to be redirected toward a second geostationary satellite by placing the satellite within the natural boresight of the antenna. Thus, the maximum gain of geostationary receive antenna 30 is maintained in the direction of the geostationary satellite. As the ground station antenna is moved, low earth orbit receive antenna 140, and low earth orbit transmit antenna 150 continue to track the appropriate satellites.

Figure 6:
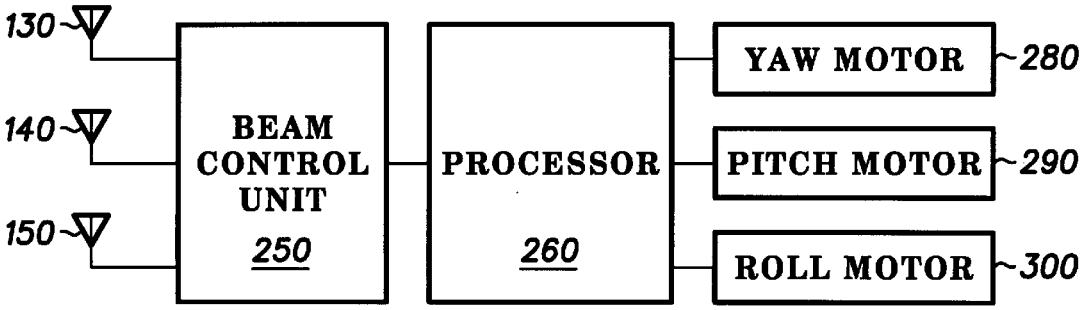
FIG. 6 illustrates a block diagram of a system used to control the scanning of the ground station antenna as well as control the orientation of the cradle assembly of FIG. 4 in accordance with an alternative embodiment of the invention.

FIG. 6 illustrates a block diagram of a system used to control transmit and receive antenna beams as well as the positioning of the ground station antenna in accordance with a preferred embodiment of the invention. In FIG. 6, geostationary receive antenna 130, low earth orbit receive antenna 140, and low earth orbit transmit antenna 150 are coupled to beam control unit 250. Beam control unit 250 provides the necessary amplitude and phase control over antennas 140, and 150, needed to create and control the appropriate receive and transmit antenna beams. In a preferred embodiment, geostationary receive antenna 130 maintains a beam at the natural boresight of the antenna. Thus, minimal processing for this antenna is included within beam control unit 250.

Beam control unit 250 is also coupled to processor 260. Processor 260 includes the appropriate processing elements required to track the position of the low earth orbit satellites which are communicating with the ground station through antennas 140 and 150. In response to position updates from the low earth orbit satellites, processor 260 commands beam control 250 to scan the receive and transmit beams of antennas 140 and 150 maintain contact with the satellites.

Processor 260 also controls yaw motor 280, pitch motor 290, and roll motor 300. In a preferred embodiment, processor 260 possesses the appropriate hardware and software elements to steer cradle 170 to a predetermined location corresponding to the desired geostationary satellite. When processor 260 determines that communications with a different geostationary satellite is required, the appropriate coordinates are transmitted to motors 260, 270, and 280 and the cradle is steered to the new location.

In an alternative embodiment, processor 260 modifies the amplitude and/or phase element weighting commands which are imposed on the elements which comprise geostationary receive antenna 130. This enables geostationary receive antenna 130 to communicate with a low earth orbiting satellite. These alternate amplitude and phase weights "spoil" the beamwidth so that the receive pattern of geostationary receive antenna 130 substantially matches that of low earth orbit receive array 140.

A hybrid geostationary and low earth orbit satellite ground station antenna facilitates simultaneous communications with both types of satellites using passive phased array technology. The antenna is mechanically positioned so as to provide a high gain, narrow antenna beam in the direction of a geostationary satellite while allowing antenna beams which provide communications with low earth orbit satellites to scan as required to maintain contact with these satellites. The antennas are mounted within a single enclosure which can be mounted to the roof of a subscriber's residence. The ground station antenna is a key element of a customer premises equipment suite that provides flexible and reliable communications services to individual consumers through the use of a hybrid satellite constellation.

Accordingly, it is intended by the appended claims to cover all modifications of the invention that fall within the true spirit and scope of the invention.

What is claimed is:

1. A ground station antenna for communicating with a plurality of satellites, said ground station antenna comprising:

a first phased array antenna which receives a signal from a first satellite;

a second phased array antenna for scanning a communications beam which receives a signal from a second satellite; and a third phased array antenna for scanning a communications beam which transmits a signal to said second satellite.

2. The ground station antenna of claim 1 wherein said first, second, and third antennas are arranged substantially coplanar to each other.

3. The ground station antenna recited in claim 1, wherein said first, second, and third antennas are mounted on a cradle which allows movement in a pitch axis.

4. The ground station antenna recited in claim 3, wherein said cradle additionally allows movement in a yaw axis.

5. The ground station antenna recited in claim 3, wherein said cradle additionally allows motion in a roll axis.

6. The ground station antenna recited in claim 1, wherein said first antenna possesses gain properties along a first axis which are different than gain properties along a second axis.

7. The ground station antenna recited in claim 1, wherein said first satellite is a geostationary satellite.

8. The ground station antenna recited in claim 1, wherein said second satellite is a low earth orbit satellite.

9. The ground station antenna recited in claim 1, wherein said first antenna additionally transmits a signal to said first satellite.

10. The ground station antenna recited in claim 1, wherein said ground station antenna additionally comprises a radome.

11. A ground station antenna for communicating with a geostationary satellite and a low earth orbit satellite, the ground station antenna comprising:

a first phased array antenna for scanning a communications beam which receives a signal from said geostationary satellite; and a second phased array antenna for scanning a communications beam which transmits a signal to said low earth orbit satellite.

12. The ground station antenna of claim 11 wherein said first and second antennas are arranged substantially coplanar to each other.

13. The ground station antenna recited in claim 11, wherein said ground station antenna additionally comprises a cradle on which said first and second antennas are mounted.

14. The ground station antenna recited in claim 11, wherein said first antenna possesses gain properties along a first axis which are different than from gain properties along a second axis.

15. The ground station antenna recited in claim 11, wherein said second antenna has gain properties achieved through modifying element weighting of a geostationary antenna.

16. The ground station antenna recited in claim 11, wherein said ground station antenna additionally comprises a radome.

17. The ground station antenna recited in claim 11, wherein said first antenna additionally transmits a signal to said geostationary satellite.

* * * * *